United States Patent [19]

Maeda

[11] Patent Number: 4,712,099

[45] Date of Patent: Dec. 8, 1987

[54] COLOR-SIGNAL CONVERTING CIRCUIT

[75] Inventor: Satoru Maeda, Kanagawa, Japan

[73] Assignee: Sony Corporation, Tokyo, Japan

[21] Appl. No.: 620,394

[22] Filed: Jun. 13, 1984

[30] Foreign Application Priority Data

Jun. 13, 1983 [JP] Japan ..... 58-105384

[51] Int. Cl.[4] ..... G09G 1/28

[52] U.S. Cl. ..... 340/703; 340/701; 340/799

[58] Field of Search ..... 340/703, 744, 750, 793, 340/799, 701, 798

[56] References Cited

U.S. PATENT DOCUMENTS 4,183,046 1/1980 Dalke et al. ..... 340/703 X
4,442,428 4/1984 Dean et al. ..... 340/703
4,464,676 8/1984 Russell et al. ..... 340/744 X
4,467,322 8/1984 Bell et al. ..... 340/703 X
4,481,594 11/1984 Staggs et al. ..... 340/703 X
4,484,187 11/1984 Brown et al. ..... 340/703
4,486,746 12/1984 Walker ..... 340/703 X
4,490,797 12/1984 Staggs et al. ..... 340/703 X

*Primary Examiner*—Gerald L. Brigance
*Attorney, Agent, or Firm*—Lewis H. Eslinger; Alvin Sinderbrand

[57] ABSTRACT

A color-signal converting circuit for generating three primary-color display signals receives a first binary data signal, which requires the use of a look-up table before it can be displayed, and a second binary data signal, which does not require a look-up table but is in a format different than the first binary data signal, and selects one of these two-inputs for display after a memory unit performs either a look-up table operation or a conversion operation, as determined by a logical circuit priority decision based on one of the two input data signals.

16 Claims, 2 Drawing Figures

FIG. 2

| | A4 | A3 | A2 | A1 | A0 | D0 | D1 (R) | D2 (R) | D3 (R) | D4 (G) | D5 (G) | D6 (G) | D7 (G) | D8 (B) | D9 (B) | D10 (B) | D11 (B) | |
|---|---|---|---|---|---|---|---|---|---|---|---|---|---|---|---|---|---|---|
| CONVERSION ARER | 1 | 0 | 0 | 0 | 0 | — | — | — | — | — | — | — | — | — | — | — | — | |
| | | 0 | 0 | 0 | 1 | 0 | 1 | 1 | 1 | 0 | 0 | 0 | 0 | 0 | 0 | 0 | 0 | HALF BRIGHTNESS |
| | | 0 | 0 | 1 | 0 | 0 | 0 | 0 | 0 | 0 | 1 | 1 | 1 | 0 | 0 | 0 | 0 | |
| | | 0 | 0 | 1 | 1 | 0 | 1 | 1 | 1 | 0 | 1 | 1 | 1 | 0 | 0 | 0 | 0 | |
| | | 0 | 1 | 0 | 0 | 0 | 0 | 0 | 0 | 0 | 0 | 0 | 0 | 0 | 1 | 1 | 1 | |
| | | 0 | 1 | 0 | 1 | 0 | 1 | 1 | 1 | 0 | 0 | 0 | 0 | 0 | 1 | 1 | 1 | |
| | | 0 | 1 | 1 | 0 | 0 | 0 | 0 | 0 | 0 | 1 | 1 | 1 | 0 | 1 | 1 | 1 | |
| | | 0 | 1 | 1 | 1 | 0 | 1 | 1 | 1 | 0 | 1 | 1 | 1 | 0 | 1 | 1 | 1 | |
| | | 1 | 0 | 0 | 0 | 0 | 0 | 0 | 0 | 0 | 0 | 0 | 0 | 0 | 0 | 0 | 0 | DARK |
| | | 1 | 0 | 0 | 1 | 1 | 1 | 1 | 1 | 0 | 0 | 0 | 0 | 0 | 0 | 0 | 0 | FULL BRIGHTNESS |
| | | 1 | 0 | 1 | 0 | 0 | 0 | 0 | 0 | 1 | 1 | 1 | 1 | 0 | 0 | 0 | 0 | |
| | | 1 | 0 | 1 | 1 | 1 | 1 | 1 | 1 | 1 | 1 | 1 | 1 | 0 | 0 | 0 | 0 | |
| | | 1 | 1 | 0 | 0 | 0 | 0 | 0 | 0 | 0 | 0 | 0 | 0 | 1 | 1 | 1 | 1 | |
| | | 1 | 1 | 0 | 1 | 1 | 1 | 1 | 1 | 0 | 0 | 0 | 0 | 1 | 1 | 1 | 1 | |
| | | 1 | 1 | 1 | 0 | 0 | 0 | 0 | 0 | 1 | 1 | 1 | 1 | 1 | 1 | 1 | 1 | |
| | | 1 | 1 | 1 | 1 | 1 | 1 | 1 | 1 | 1 | 1 | 1 | 1 | 1 | 1 | 1 | 1 | |
| | 0 | LOOK-UP TABLE AREA | | | | | | | | | | | | | | | | |

5

COLOR-SIGNAL CONVERTING CIRCUIT

BACKGROUND OF THE INVENTION

1. Field of the Invention

The present invention relates generally to color-signal converting circuits and, more specifically, to a color-signal converting circuit for generating color display signals for use with a cathode ray tube used in a character and image information display system.

2. Description of the Prior Art

Character and image information systems, such as videotex, teletext, and the like, are known that use memorized conversion tables, for example, a color look-up table in order to display character and image information on cathode ray tube displays with relatively small memories. In conjunction with these systems, there are also known systems in which an independent picture, for example, an animation picture or the like, not requiring a look-up table is displayed on the same display screen in a so-called superposed state with the picture based upon the contents of the look-up table.

In regard to the display of the picture image using the look-up table, in one example of such known system there are produced four-bits of color-display data for each of the red (R), green (G), and blue (B) signal data from the look-up table. The data thus derived are converted to analog signals by a digital-to-analog converter (D/A) and then supplied to a color cathode ray tube for visual display. On the other hand, it is also known to use data for displayaing a color picture image that does not require the use of a look-up table, and which are represented by one bit for each element of the red (R), green (G), blue (B), and brightness or luminance (Y) signal. Therefore, when a picture image derived from a look-up table and a picture image that need not be derived from a look-up table are to be displayed together in the so-called superposed state, in this example it is necessary to convert the one-bit data to four-bit data for each of the red, green, and blue data points and then mix it with the display data derived from the look-up table. Additionally, because the picture image that is not derived from the look-up table can typically have three brightness conditions, such as full brightness, half brightness, and no brightness (dark), the brightness data must also be converted to four-bit display data, such as "1111", "0111", and "0000", respectively, and then also mixed with the display data derived from the look-up table.

Therefore, because both kinds of color-signal data may be presented to this known system, a separate data generating circuit is necessary in order to generate the four-bit display data for each of the red, green, and blue elements, based on each of the original one-bit data points. Also, a mixing circuit is required in order to mix the generated four-bit display data with the four-bit display data derived from the look-up table. This also presents a problem, because two kinds of four-bit color-signal display data are mixed with one another, and because they are generated by different systems, signal processing delays must be taken into consideration and, therefore, the circuit arrangement is necessarily made complicated.

Additionally, the picture derived from the look-up table need not be limited to a single picture and the number may be increased gradually so that many pictures can be displayed in the superposed state. When this becomes a major consideration in known systems, the four-bit signal generator and the mixer circuit and other circuit elements must be increased in scale, and the problems caused by signal processing delays become significant. Also, if display speed is increased then the system timing and delays are also affected so that the entire system arrangement can be adversely affected.

OBJECTS AND SUMMARY OF THE INVENTION

Accordingly, it is an object of the present invention to provide a color-signal converting circuit which can eliminate the above-noted defects inherent in the prior art.

Another object of the present invention is to provide a color-signal converting circuit that can convert display data to color signals without requiring a signal generator circuit, a mixer, and other circuit elements required by the prior art.

A still further object of the present invention is to provide a color-signal converting circuit for generating three primary color display signals suitable for use in the display portion of a character and image information display system, such as videotex, teletext, or the like.

In accordance with one aspect of the present invention, there is provided a color-signal converting circuit for generating three primary color display signals that includes a selector circuit supplied with first binary data representing one of the color signals to be displayed and second binary data representing the other color signal to be displayed and which selects one or the other of these binary signals depending on a generated switching signal based on the contents of one of the groups of binary data. A memory is supplied with the switching signal and one of the first or second binary data groups as address data for generating three selected primary color display signals.

The above, and other objects, features, and advantages of the present invention will become apparent from the following detailed description of illustrative embodiments thereof to be read conjunction with the accompanying drawings in which like reference designate the same elements and parts.

BRIEF DESCRIPTION OF THE DRAWINGS

FIG. 2 is a representation of a conversion table useful in explaining the color-signal converting circuit of FIG. 1.

DESCRIPTION OF PREFERRED EMBODIMENTS

Figure 1:
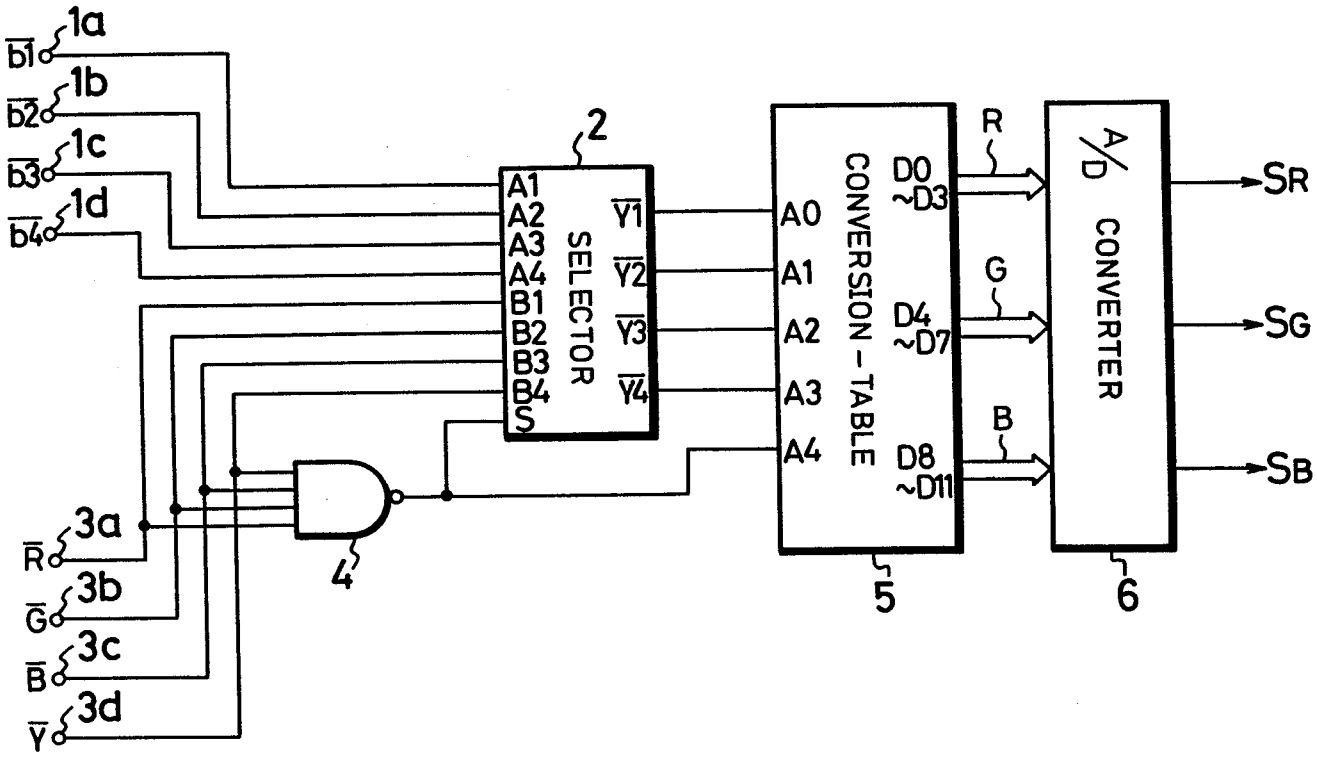
FIG. 1 is a block diagram of one embodiment of a color-signal converting circuit according to the present invention.

FIG. 1 schematically represents a color-signal converting circuit wherein a picture image based on a signal requiring a color look-up table and another picture image derived from a signal not requiring a look-up table are to be displayed on the same color display, such as a cathode ray tube, not shown. In this embodiment priority is granted to display the picture image not requiring a look-up table over the picture image that must be obtained from the look-up table. For example, only when the color-signal data not requiring the look-up table, has values so that $\overline{R}$, $\overline{G}$,$\overline{B}$, $\overline{Y}$, and are all "1"s, will the picture image based on the look-up table be used to drive the color display.

In FIG. 1, terminals 1*a*, 1*b*, 1*c*, and 1*d* receive the four-bit color-signal display data for subsequent use with the look-up table, represented as bits $\overline{b1}$, $\overline{b2}$, $\overline{b3}$, and $\overline{b4}$. These four bits of color display data are respectively supplied to input terminals A10, A20, A30, and A40 of selector unit 2. On the other hand, terminals 3*a*, 3*b*, 3*c*, and 3*d* receive the color display data $\overline{R}$, $\overline{G}$, $\overline{B}$and $\overline{Y}$, which are supplied respectively to input terminals B1, B2, B3, and B4 of selector 2. These single bits of color signal data re not intended for use with a look-up table and can be used directly to produce one of the three primary color displays.

The color display data $\overline{R}$, $\overline{G}$, $\overline{B}$, and $\overline{Y}$, are supplied respectively to four inputs of logical NAND circuit 4, and the output from NAND circuit 4 is fed to a select input terminal S of selector unit 2. Thus, NAND circuit 4 will always produce an output "1" unless all four input terminals 3*a*, 3*b*, 3*c*, and 3*d* have "1"s applied thereto. This provides the priority function mentioned above.

When a data bit "0" is supplied to select terminal S of selector unit 2 from NAND circuit 4, selector unit 2 will produce at its output terminals $\overline{Y1}$, $\overline{Y2}$, $\overline{Y3}$, and $\overline{Y4}$ the color display data which results from inverting the color display data, $\overline{b1}$, $\overline{b2}$, $\overline{b3}$, and $\overline{b4}$, that is present at input terminals A10, A20, A30, and A40, respectively, of selector unit 2. Conversely, when a data bit "1" is supplied to select terminal S of selector unit 2 from NAND circut 4, selector unit 2 will produce at its output terminals, $\overline{Y1}$, $\overline{Y2}$, $\overline{Y3}$, and $\overline{Y4}$ the color display data resulting from inverting the single-bit color display data, $\overline{R}$, $\overline{G}$, $\overline{B}$, and $\overline{Y}$, supplied to input terminals B1, B2, B3, and B4, respectively, of selector unit 2. The outputs from selector unit 2 are fed to conversion table unit 5, as is the output from NAND circuit 4. Thus, selector unit 2 selects one or the other of the color-signal inputs based on the output of NAND circuit 4 and produces the inverted input at its respective terminals.

Conversion table 5 is preferably formed of a random-access memory and includes a look-up table area and a color conversion area, which is assigned to the color signal not requiring the look-up table. The division of conversion table 5 into the look-up table and conversion area is represented in FIG. 2. As in the known look-up tables, predetermined display data having four bits corresponding to the three primary color signals red, blue and green are written into the look-up table area of conversion table 5 so that this four-bit color signal data can be addressed by the outputs from selector 2 and NAND circuit 4. Because such look-up tables are well known it is not shown herein in detail in the interests of clarity and brevity. The display data, on the other hand, including luminance data "1111", "0111", and "0000" representing full brightness, half brightness, and no-brightness, respectively, and the color signal data relating to each of three primary colors, red, blue, gren, and blue are written respectively into the conversion area of conversion table 5, as shown in FIG. 2.

The input terminals A0, A1, A2, A3 receive the outputs developed by selector unit 2 at output terminals $\overline{Y1}$, $\overline{Y2}$, $\overline{Y3}$, and $\overline{Y4}$, respectively, and the output from NAND circuit 4, in addition to being connected to selector terminal S of selector unit 2, is also connected to input terminal A4 of conversion table 5. These inputs A0, A1, A2, A3, and A4 are the address signals for addressing the contents of the conversion table unit 5.

Therefore, when data signal "0" is present at the address input terminal A4, the color display data b1, b2, b3, and b4 are supplied, respectively, to input terminals A0, A1, A2, and A3, so that the four-bit display data relating to the three primary colors red, green, and blue are read out from predetermined addresses in the look-up table area and are developed at the output terminals of conversion table unit 5. More specifically, the four-bit red primary color-signal data is developed at four output terminals D0, D1, D2, and D3; the four-bit green primary color-signal data is developed at output terminals D4, D5, D6, and D7; and the four-bit blue primary color-signal data is developed at output terminals D8, D9, D10, and D11 of conversion table unit 5.

When the data signal "1" is produced by NAND circuit 4, which means that at least one of the $\overline{R}$, $\overline{G}$, $\overline{B}$, and $\overline{Y}$ inputs thereto are "0", is fed to the address terminal A4 of selector unit 2, the color display data R, G, B, and Y are respectively supplied to input terminals A0, A1, A2, and A3 of the conversion table 5, along with the output of NAND circuit 4 at terminal A4. Conversion table 5 then operates to provide four-bit data of the three primary color signals for display, that is, conversion table 5 has read out therefrom at the predetermined addresses in the conversion area the four-bit data relating to the three primary color-signals red, green, and blue and, specifically, at output terminals D0 to D3, D4 to D7, and D8 to D11, respectively.

The four-bit color-display data representing the three primary color-display signals, red (R), green (G), and blue (B), as developed at output terminals D0 to D3, D4 to D7, and D8 to D11, respectively, are input to digital-to-analog convertor 6 and are therein converted to corresponding analog signals $S_R$, $S_G$, $S_B$, respectively. These analog color signals $S_R$, $S_G$, and $S_B$ are fed to a color cathode ray tube display (not shown) and the desired predetermined display is performed.

In operation of the inventive system described hereinabove, when the color display data $\overline{R}$, $\overline{G}$, $\overline{B}$, and $\overline{Y}$ of the color-signal not requiring a look-up table are all "1"s, and in this embodiment this means that the picture image is substantially transparent and colorless, the output from NAND circuit 4 will be "0". As a result of this, color display data b1, b2, b3, and b4 of the color-signal requiring the look-up table are respectively developed at output terminals $\overline{Y1}$, $\overline{Y2}$, $\overline{Y3}$, and $\overline{Y4}$, of selector unit 2. This color display data b1, b2, b3, and b4 is then fed to input terminals A0, A1, A2, and A3 of conversion table unit 5 and the output "0" from NAND circuit 4 is also supplied to address terminal A4, of conversion table unit 5, whereby the four-bit display data relating to the three primary-color display signals, red, green, and blue, is read out from predetermined addresses in the look-up table area and is developed at the three sets of output terminals, D0 to D3, D4 to D7, and D8 to D11, respectively, of conversion table unit 5. Accordingly, display of the color signal based upon the look-up table is carried out.

In a situation when the color-signal display data $\overline{R}$, $\overline{G}$, $\overline{B}$, and $\overline{Y}$ of the video signal not requiring the look-up table are not all "1"s, that is, the picture is not transparent and is not colorless, the output from the NAND circuit 4 will be a "1", thus, color display data R, G, and B, and Y of such video picture are produced at output terminals $\overline{Y1}$, $\overline{Y2}$, $\overline{Y3}$, and $\overline{Y4}$ of selector unit 2, and is fed to input terminals A0, A1, A2, and A3 of conversion table unit 5. Also fed to input terminals A4 of conversion table 5 is the output "1" from NAND circuit 4. Thus, this signal at terminal A4 selects the conversion area of the conversion table 5 so that four-bit display data is read out from predetermined addresses of the conversion area (as represented in FIG. 2) and are developed at output terminals D0 to D3, D4 to D7, and D8 to D11 and, thus, the color-signal picture not requiring a lookup table is displayed.

As a further example, when $\overline{R}$="0", $\overline{G}=\overline{B}$="1" and $\overline{Y}$="0" the data "11001" are supplied to input terminals A4, A3, A2, A1 and A0, respectively, of conversion table 5. Note that the selector bit A4 is in the most significant bit position of this word. Thus, display data of four bits, each relative to the red, green, and blue primary colors, is developed at output terminals D0 to D3, D4 to D7, and D8 to D11, respectively, of conversion table unit 5. This four-bit data for the red, green, and blue primary colors is, respectively, "1111", "0000", and "0000". Thus, a red color having a full brightness is displayed on the screen of the color cathode ray tube (not shown).

As described hereinabove according to the present invention, in order to display a picture derived from a look-up table, as well as a picture not requiring a look-up table in the so-called superposed state, no separate signal generating circuit for generating the display data of four bits relating to the red, green, and blue from the one-bit color display data is required, nor is there required a mixing circuit for mixing the generated display data of four bits each with the four bit display data requiring a look-up table. Moreover, because display data are processed by the same signal processing system there is no problem of data delay contained in the system and the circuit arrangement is relatively uncomplicated.

Although in the above example of the present invention only a single picture based on the look-up table and a single picture not requiring the look-up table is presented, the present invention can also be applied to the case in which many more pictures are superposed one on the other.

As described above, the color signal converting circuit provided by the present invention includes a selector unit, which is supplied with the first and second color-display data, for selecting either one of these first and second color display data in accordance with the contents of selected data, and a conversion table is supplied with selected color display data and produces such display data corresponding to three primary colors for display on a color cathode ray tube. Thus, as is evident from the above, even when a picture based on the look-up table and picture not based on the look-up table are displayed in superposed relationship one on the other, a signal generating circuit and a mixing circuit are not required. Additionally, because the color-signal display data are processed by the same system, problems caused by circuit delays are not serious and the arrangement can be relatively uncomplex.

Although illustrative embodiments of the present invention have been described in detail above with reference to the accompanying drawings, it is to be understood that the invention is not limited to those precise embodiments, and that various changes and modifications can be effected therein by one skilled in the art without departing from the scope or spirit of the invention, as defined by the appended claims.

What is claimed is:

1. Color-signal converting apparatus for producing primary-color display signals, said apparatus comprising:

selector means receiving a first binary data signal for use with a look-up table, said first binary data signal representing a first color-signal, and a second binary data signal for use in direct display of a second color-signal, said selector means selectively supplying as outputs one or the other of said first and second binary data signals;

logic circuit means responsive to said second binary data signal for producing a logic output signal fed to said selector means to control the operation thereof, said logic output signal having a state depending on the condition of said second binary data signal; and conversion means receiving said outputs from said selector means and receiving said logic output signal from said logic circuit means for generating said primary-color display signals from said outputs of said selector means in response to said logic output signal;

wherein said logic circuit means includes a logical NAND gate responsive to said second binary data signal for producing said logic output signal in response thereto.

2. Apparatus according to 1, in which said first binary data signal comprises display data requiring a look-up table and said second binary data signal comprises direct display data and in which said conversion means comprises a random access memory divided into at least two areas including a look-up table area and a conversion area, said areas being selected by said logical output signal, and said first binary data signal being fed to said look-up table area and said second binary data signal being fed to said conversion area in response to a predetermined state of said logical output signal.

3. Apparatus according to claim 1, in which said converstion means includes a ditigal-to-analog converter means for producing said primary-color display signals as analog signals.

4. Color-signal converting apparatus for producing primary-color display signals, said apparatus compromising:

selector means receiving a first binary data signal for use with a look-up table, said first binary data signal representing a first color-signal, and a second binary data signal for use in direct display of a second color-signal, said selector means selectively supplying as outputs one or the other of said first and second binary data signals;

logic circuit means receiving said second binary data signal and producing a logic output signal fed to said selector means to control the operation thereof, said logic output signal having a state depending on the condition of said second binary data signal; and conversion means receiving said outputs from said selector means and receiving said logic output signal from said logic circuit means for generating said primary-color display signals from said outputs of said selector means in response to said logic output signals;

wherein said logic circuit means includes a logical NAND gate responsive to said direct display data for producing said logic output signal in response thereto;

said conversion means comprising a random access memory divided into at least two areas including a look-up table area and a conversion area, said areas being selected by said logic output signal, and said first binary data signal being fed to said look-up table area and said second binary data signal being fed to said conversion area in response to a predetermined state of said logic output signal;

wherein when said second binary data signal corresponds to a portion of an associated picture image which is not intended to be visible, said logic output signal causes said selector means to select said first binary data signal as addresses in said look-up table area of said random access memory.

5. Apparatus according to claim 4, further comprising means associated with said conversion area of said conversion means for producing primary-color signals having different gradations of brightness.

6. Color signal converting apparatus for producing primary-color display signals from first binary data representing look-up table data and from second binary data representing direct display data, said apparatus comprising:

selector means connected to receive said first binary data and said second binary data for selectively supplying one or the other thereof at outputs thereof;

logic circuit means connected to receive said second binary data for producing a logic output signal in response to predetermined conditions of said second binary data, said logic output signal being fed to said selector means to control the operation thereof; and memory means connected to said outputs of said selector means for receiving a selected one of said first and second binary data signals and said logic output signal as address data for generating selected primary-color display signals by reference to a look-up table or by direct display, depending on the state of said logic output signal.

7. Apparatus according to claim 6, in which said conversion means includes a digital-to-analog convertor for producing said primary-color display signals as analog signals.

8. Apparatus according to claim 6, in which said memory means comprises a random-access memory divided into at least two areas including a look-up table area and a conversion area, said areas being selected in response to said logical output signal.

9. Color signal converting apparatus for producing primary-color display signals from first binary data for use with a look-up table, said first binary data signal representing look-up table data, and from second binary data representing direct display data, said apparatus comprising:

selector means connected to receive said first binary data and said second binary data for selectively supplying one or the other thereof at outputs thereof;

logic circuit means connected to receive said second binary data for producing a logic output signal in response to predetermined conditions of said second binary data, said logic output signal being fed to said selector means to control the operation thereof; and memory means connected to said outputs of said selector means for receiving a selected one of said first and second binary data signals and said logic output signal as address data for generating selected primary-color display signals;

said memory means including means for addressing in which said first binary data addresses said look-up table and said second binary data addresses said conversion area, in response to a preselected state of said logic output signal;

said memory means including means for addressing in which said first binary data addresses said look-up table and said second binary data addresses said conversion area, in response to a preselected state of said logic output signal.

10. Apparatus according to claim 9, in which when said second binary data corresponds to a portion of an associated picture image which is not intended to be visible, said logic output signal causes said selector means to select said first binary data and causes said memory means to select said look-up table area in said random access memory.

11. Apparatus according to claim 10, further comprising means associated with said conversion area in said random access memory for producing said primary-color signals having different gradations of brightness.

12. Color-signal converting apparatus for producing primary-color display signals selectively from look-up table display data and direct display data, said apparatus comprising:

selector means connected to receive said look-up table display data and said direct display data for selectively supplying one or the other thereof at outputs of said selector means;

logic circuit means connected to receive said direct display data for producing a logic output signal in response to predetermined conditions of said direct display data, said logic output signal being fed to said selector means to control the operation thereof; and memory means connected to said outputs of said selector means for receiving a selected one of said display data and said logic output signal as address data for generating selected primary-color display signals by reference to a look-up table or by direct display, depending on the state of said logic output signal.

13. Apparatus according to claim 12, in which said conversion means includes a digital-to-analog convertor for producing said primary-color display signals as analog signals.

14. Apparatus according to claim 12, in which said memory means comprises a random-access memory divided into at least two areas including a look-up area and a conversion area, said areas being selected in response to said logical output signal.

15. Color-signal converting apparatus for producing primary-color display signals from look-up table display data and from direct display data, said apparatus comprising:

selector means connected to receive said look-up table display data and said direct display data for selectively supplying one or the other thereof at outputs of said selector means;

logic circuit means connected to said direct display data for producing a logic output signal in response to predetermined conditions of said direct display data, said logic output signal being fed to said selector means to control the operation thereof; and memory means connected to said outputs of said selector means for receiving a selected one of said display data and said logic output signal as address data and generating selected primary-color display signals in response thereto;

said memory means comprising a random access memory divided into at least two areas including a look-up area and a conversion area, said areas being selected in response to said logical output signal;

wherein, when said direct display data corresponds to a portion of an associated picture image which is not intended to be visible, said logic output signal causes said selector means to select said look-up table display data and causes said memory means to select said look-up table in said random access memory.

16. Apparatus according to claim 15, further comprising means associated with said conversion area in said random access memory for producing said primary-color signals having different gradations fo brightness.

* * * * *